US009898883B1

(12) United States Patent
Chang et al.

(10) Patent No.: US 9,898,883 B1
(45) Date of Patent: Feb. 20, 2018

(54) DUAL-BILL PASSAGE AUTO-SEARCH BILL ACCEPTOR

(71) Applicant: INTERNATIONAL CURRENCY TECHNOLOGIES CORPORATION, Taipei (TW)

(72) Inventors: Chia-Min Chang, Taipei (TW); Hung-Yi Chang, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 15/403,492

(22) Filed: Jan. 11, 2017

(30) Foreign Application Priority Data

Oct. 21, 2016 (TW) ..... 105134085 A

(51) Int. Cl.
*G07F 7/04* (2006.01)
*G07D 11/00* (2006.01)

(52) U.S. Cl.
CPC ..... *G07D 11/0087* (2013.01); *G07D 11/0018* (2013.01); *G07D 11/0021* (2013.01); *G07D 11/0024* (2013.01); *G07D 11/0054* (2013.01)

(58) Field of Classification Search
CPC .. G07D 7/00; G07D 11/0018; G07D 11/0021; G07D 11/0033; G07D 11/0054; G07D 11/006; G07D 11/0084; G07D 11/0087
See application file for complete search history.

(56) References Cited

U.S. PATENT DOCUMENTS 8,967,389 B2 * 3/2015 Tomiyoshi ..... G07D 11/0081 194/344
2006/0163027 A1 * 7/2006 Hobmeier ..... B65H 29/006 194/207
2009/0171499 A1 * 7/2009 Afanasov ..... B65H 29/44 700/215

* cited by examiner

*Primary Examiner* — Mark J Beauchaine
(74) *Attorney, Agent, or Firm* — Muncy, Geissler, Olds & Lowe, P.C.

(57) ABSTRACT

A dual-passage auto-search bill acceptor includes an acceptor housing including a lower bill-inlet passage, an upper bill-outlet passage, a bill-presser and a bill-transfer mechanism mounted for transferring a bill through the bill-inlet passage to the bill-presser, a cash box mounted in a rear bottom side of the acceptor housing, and a bill dispenser mounted at a top side of the acceptor housing and including a bill-return passage in communication with the bill-inlet passage and the bill-outlet passage, a storage module with a first bill-receiving wheel, a register module with a second bill-receiving wheel and a control gate biasable to open and close a bill passage between the storage module and the register module for enabling the first bill-receiving wheel to take up bills for storage or the second bill-receiving wheel to take up bills for giving change.

12 Claims, 10 Drawing Sheets

DUAL-BILL PASSAGE AUTO-SEARCH BILL ACCEPTOR

BACKGROUND OF THE INVENTION

This application claims the priority benefit of Taiwan patent application number 105134085, filed on Oct. 21, 2016.

1. Field of the Invention

The present invention relates to bill acceptor technology and more particularly, to a dual-passage auto-search bill acceptor, which comprises an acceptor housing, a cash box mounted at the back side of the acceptor housing, and a bill dispenser mounted at the top side of the acceptor housing and adapted for controlling a control gate to switch the bill-transfer passage between a storage module and a register module, achieving the function of picking up a specific bill from mixed bills.

2. Description of the Related Art

Fast development of modern technology accelerates the pace of people's lives and brings convenience and rapidness to people. Nowadays, various automated trading machines, such as automatic vending machines, card dispensers, automated teller machines, ticket machines, game machines, bill exchange machines, etc. are used everywhere to receive and recycle bills, securities, coupons or other valuable documents and to sell different products and/or to provide different services without serviceman. These machines are highly appreciated for the advantage of saving much labor and bringing convenience to people. Further, these machines are commonly equipped with a bill acceptor for receiving bills, and a bill recognition device for identifying the authenticity and value of inserted bills before receiving them. Thus, these machines can achieve unmanned operation and self-service purposes, saving the operation cost. Nowadays, advanced vending machines have been continuously created for selling a variety of products and providing versatile services.

Further, in order to sell more items and more expensive products or to accept higher denomination of bills, automatic vending machines or automated teller machines must be equipped with a bill dispenser for dispensing bills after recognized by a bill recognition device so that received bills of maximum denomination can be transferred to a cash box for storage, and received bills under a predetermined face value can be temporarily stored in a storage device for giving change or for exchange, reducing the frequency and cost of manual replenishment of bills increasing the service time.

Two methods are commonly used in commercial automatic vending machines, automated teller machines and other automated trading machines for dispensing assorted bills and giving change. The first method is the use of one single bill dispenser. In this case, when picking up specific bills from mixed bills, the bill dispenser needs to deliver nonspecific bills to the cash box for storage so that specific bills can be picked up and delivered to the bill-outlet slot for giving change or making an exchange. However, the bills that have been transferred to the cash box can no longer be picked up for giving change. The second method is the use of two or more bill dispensers. In this case, bills of different values are separately stored in respective storages devices in the bill dispensers. When giving change or making an exchange, the system main unit drives the bill dispensers to release bills one after another in a proper order, and the desired specific bills will be transferred to the bill-outlet slot only when they have all been picked up. However, this multiple bill dispenser design requires a long bill passage and multiple electromagnetic valves for controlling multiple gates to achieve the desired dispensing operation. In consequence, the machine of this multiple bill dispenser design has drawbacks of large size, complicated structure and high manufacturing cost.

Therefore, it is desirable to provide a measure that eliminates the drawbacks of the aforesaid prior art design.

SUMMARY OF THE INVENTION

The present invention has been accomplished under the circumstances in view. It is therefore one object of the present invention to provide a dual-passage auto-search bill acceptor, which is capable of controlling a control gate to close or open the bill-transfer passage between a storage module and a register module, achieving the function of picking up a specific bill from mixed bills.

To achieve this and other objects of the present invention, a dual-passage auto-search bill acceptor comprises an acceptor housing, a cash box, and a bill dispenser. The acceptor housing comprises a base, a bill-inlet passage defined in the base for receiving a bill inserted by a user, a bill-outlet passage defined in the base and extended upwardly from a rear end of the bill-inlet passage, a bill-transfer mechanism mounted in the base for transferring a bill through the bill-inlet passage for bill intake or bill return and also for transferring a bill through the bill-outlet passage for giving change, and a bill-presser mounted in the base below the bill-transfer mechanism. The cash box comprises a box body mounted at a rear bottom side of the base of the acceptor housing and defining therein a bill accommodation chamber for receiving bills being pressed by the bill-presser. The bill dispenser comprises a dispenser housing mounted at a top side of the base, a bill-return passage defined in the dispenser housing in communication with the bill-inlet passage and the bill-outlet passage, a storage module with a first bill-receiving wheel, a register module with a second bill-receiving wheel, and a control gate biasable to open and close a bill passage between the storage module and the register module. The bill dispenser is adapted for performing a bill-collection process and a giving-change process selectively. When performing the bill collection process, the bill-transfer mechanism is controlled to transfer a bill from the bill-return passage to the storage module for enabling the bill to be rolled up onto the first bill-receiving wheel. When performing the giving-change process, the first bill-receiving wheel is controlled to transfer specific bills from mixed bills through the bill-return passage into the bill-outlet passage for giving change to the user, enabling the bills coming before the specific bills to be transferred over the control gate into the register module and rolled up onto the second bill-receiving wheel for temporary storage and then delivered back to the storage module for storage after completion of the procedure of giving change. Since this one single bill dispenser is capable of achieving the above-described operation, it does not occupy much installation space in the acceptor housing, simplifying the overall structure of the bill acceptor, minimizing the amount of component parts, facilitating installation and reducing the manufacturing cost.

According to another aspect of the present invention, the acceptor housing further comprises a bill recognition device mounted in the base to face toward the bill-inlet passage and adapted for recognizing the authenticity of each bill being transferred by the bill-transfer mechanism so that if a bill is recognized by the bill recognition device to be a true bill of the maximum denomination, the bill-transfer mechanism is controlled to transfer the bill to the bill-presser, and then the bill-presser is controlled to press the bill into the box body of the cash box; if a bill is recognized by the bill recognition device to be a counterfeit or the user cancels the trading, the bill-transfer mechanism is controlled to transfer the bill backwardly through the bill-inlet passage for returning to the user.

According to still another aspect of the present invention, when the bill recognition device judges that an inserted bill is usable for giving change, the bill-presser is controlled to transfer the bill upwardly through the bill-inlet passage toward the bill-return passage of the bill dispenser for collection. Thus, the bill dispenser can control the control gate to close or open the bill passage between the storage module and the register module for the selection of specific bills from mixed bills and bill dispenser, enabling the bills that can be used for giving change and come before the specific bills to be transferred over the control gate into the register module and rolled up onto the second bill-receiving wheel for temporary storage and then delivered back to the storage module for storage after completion of the procedure of giving change.

According to still another aspect of the present invention, the acceptor housing further comprises a recessed portion located in the base and facing toward the bill-outlet slot, and a fence-like auto-return safety gate pivotally mounted in the recessed portion for prohibiting movement of a bill from the bill-outlet slot into the bill-outlet passage and allowing movement of a bill from the bill-outlet passage toward the bill-outlet slot.

DETAILED DESCRIPTION OF THE PREFERRED EMBODIMENT

Figure 1:
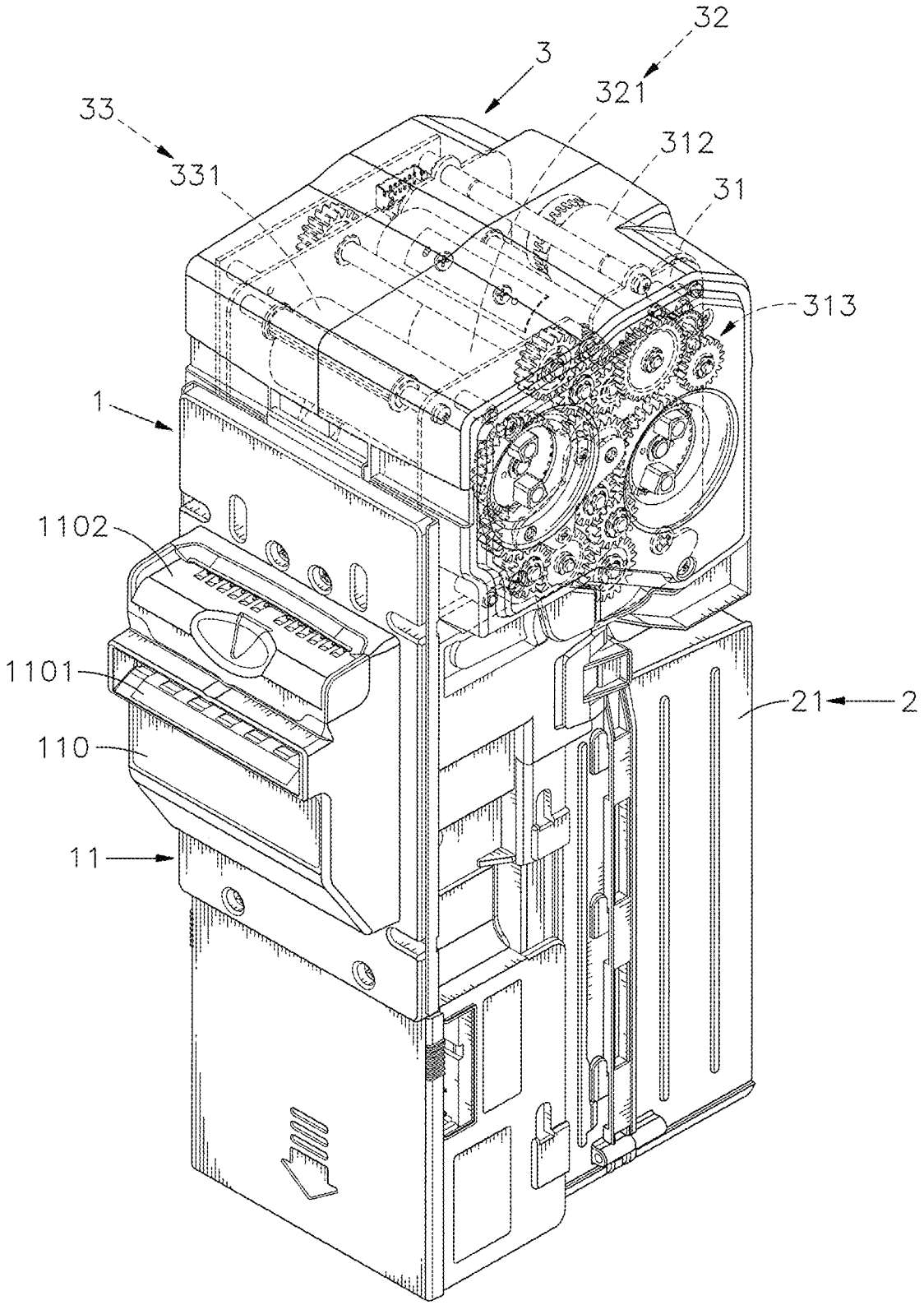
FIG. 1 is a perspective view of a dual-bill passage auto-search bill acceptor in accordance with the present invention.
Figure 2:
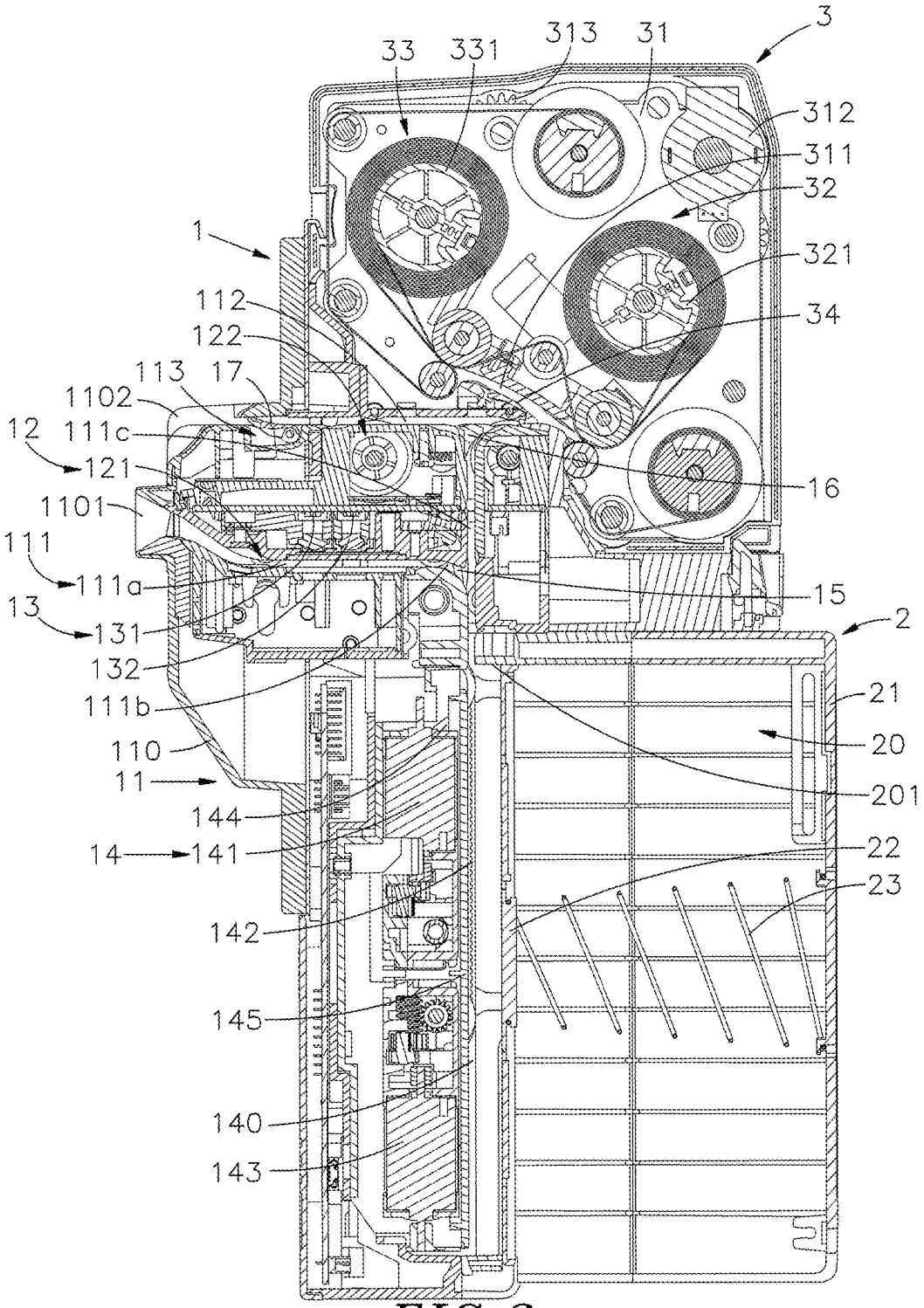
FIG. 2 is a schematic sectional side view of the dual-bill passage auto-search bill acceptor in accordance with the present invention.
Figure 3:
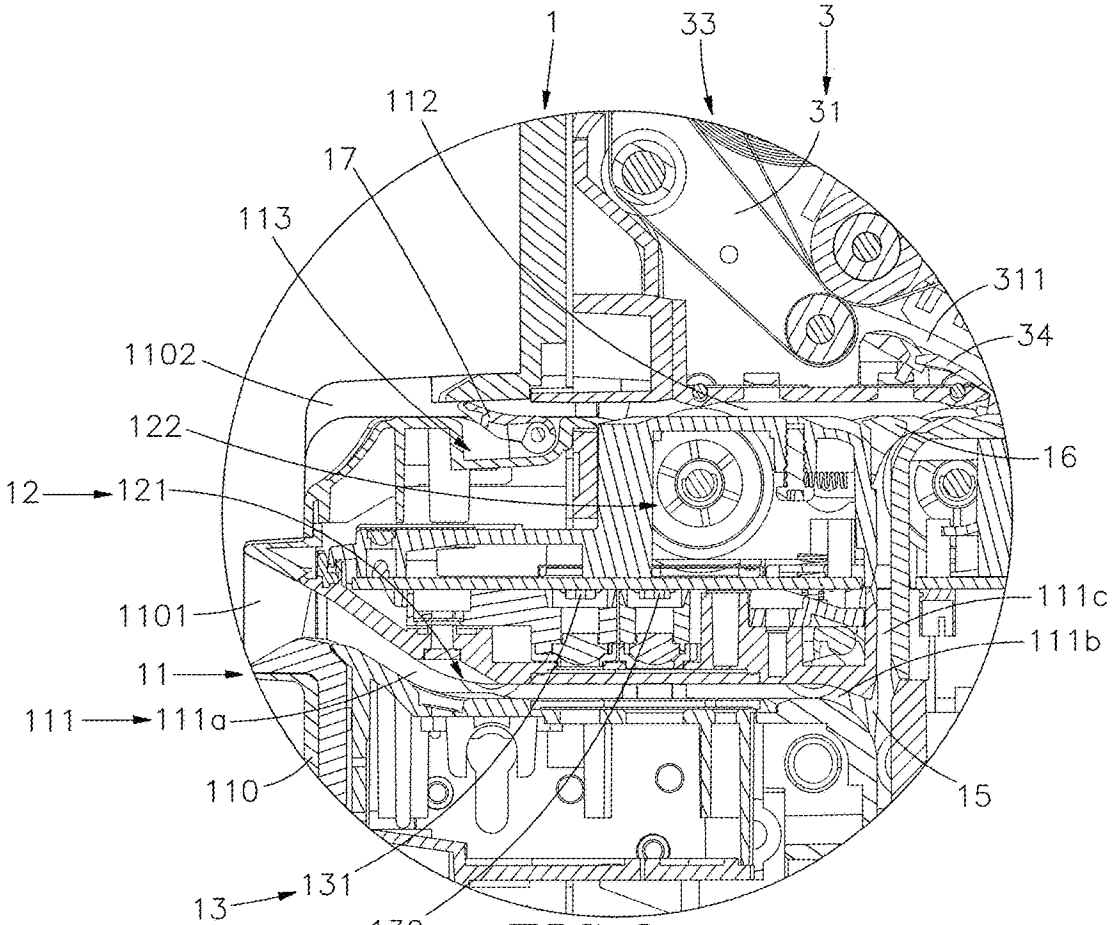
FIG. 3 is an enlarged view of a part of FIG. 2.

Referring to FIGS. 1-3, a dual-bill passage auto-search bill acceptor in accordance with the present invention is shown. The dual-bill passage auto-search bill acceptor comprises an acceptor housing 1, and a cash box 2, and a bill dispenser 3.

The acceptor housing 1 comprises a base 11, a face panel 110 mounted at a front side of the base 11 and defining therein a bill-inlet slot 1101 and a bill-outlet slot 1102, a bill-inlet passage 111 and a bill-outlet passage 112 defined in the base 11 and respectively backwardly extended from the bill-inlet slot 1101 and the bill-outlet slot 1102, a control system (not shown), a first bill-transfer roller set 121 of a bill-transfer mechanism 12 and a bill recognition device 13 mounted in the base 11 in a proper order to face toward the bill-inlet passage 111, a bill-presser 14 mounted in the base 11 below the bill-transfer mechanism 12, and a second bill-transfer roller set 122 of the bill-transfer mechanism 12 mounted in the base 11 to face toward the bill-outlet passage 112. The bill recognition device 13 comprises a light transmitter 131 and a light receiver 132 respectively disposed at the same side or two opposite sides relative to the bill-inlet passage 111.

Further, a bill-pressing passage 140 is longitudinally defined in the base 11 at a back side of the bill-presser 14 and connected to an inner end of the bill-inlet passage 111. The bill-presser 14 comprises a first motor 141, a transmission wheel set 142 rotatably by the first motor 141, a second motor 143, a linkage 144 coupled between the second motor 143 and a bill-pressing plate 145 and drivable by the second motor 143 to move the bill-pressing plate 145. Further, the bill-inlet passage 111 comprises a front section 111*a* connected to the bill-inlet slot 1101, a curved section 111*b* curved downwardly from an inner end of the front section 111*a* remote from the bill-inlet slot 1101 and terminating in the bill-pressing passage 140, and a shunt section 111*c* upwardly extended from the curved section 111*b* and terminating in the bill-outlet passage 112. Further, an anti-theft hook 15 is pivotally mounted in the curved section 111*b* of the bill-inlet passage 111; an anti-backflow gate 16 is pivotally mounted in the connection area between the shunt section 111*c* and the bill-outlet passage 112.

The cash box 2 comprises a box body 21 detachably mounted in a rear lower side of the base 11 to face toward the bill-presser 14 and defining therein a bill accommodation chamber 20 and an opening 201 in a front side of the bill accommodation chamber 20, a bearing plate 22 placed in the bill accommodation chamber 20 of the box body 21 and pressable by the bill-pressing plate 145 to move in the bill accommodation chamber 20 in direction away from the opening 201, and a plurality of spring members 23 mounted in a bottom side of the bill accommodation chamber 20 and abutted against a bottom wall of the bearing plate 22 to support the bearing plate 22 in the bill accommodation chamber 20 in balance and adapted for imparting an elastic restoring force to the bearing plate 22 toward the opening 201.

The bill dispenser 3 is mounted at a top side of the base 11 comprising a dispenser housing 31, a bill-return passage 311 defined in the dispenser housing 31 in communication with the bill-inlet passage 111 and the bill-outlet passage 112, a first bill-receiving wheel 321 of a storage module 32, a second bill-receiving wheel 331 of a register module 33 respectively mounted in the dispenser housing 31 and disposed to face toward the bill-return passage 311, a control gate 34 mounted in the dispenser housing 31 and adapted for switching the passage between the storage module 32 and the register module 33, at least one motor 312 mounted in the dispenser housing 31, and a gear transmission mechanism 313 mounted in the dispenser housing 31 and drivable by the motor 312 to rotate the first bill-receiving wheel 321 and the second bill-receiving wheel 331. Further, the control gate 34 can be a panel or grating mounted between the storage module 32 and the register module 33 and movable by an electromagnetic valve through a link.

In application, the dual-bill passage auto-search bill acceptor can be used in an automatic vending machine, automatic teller machine, game machine, or any other automated trading machine that provides exchange, purchase of goods, consumer services. After installation of the acceptor housing 1 in an automated trading machine, the control system of the acceptor housing 1 and the driving mechanism of the bill dispenser 3 are electrically connected to the host unit of the automated trading machine for data and power transmission. In actual application, the dual-bill passage auto-search bill acceptor can be used independently, enabling the driving mechanism of the bill dispenser 3 to be electrically connected to the control system of the acceptor housing 1 for data and power transmission. After installation of the dual-bill passage auto-search bill acceptor in the automatic vending machine, automatic teller machine, game machine or automated trading machine, the dual-bill passage auto-search bill acceptor provides the automatic vending machine, automatic teller machine, game machine or automated trading machine with exchange, purchase of goods, consumer services and other functions.

Figure 4:
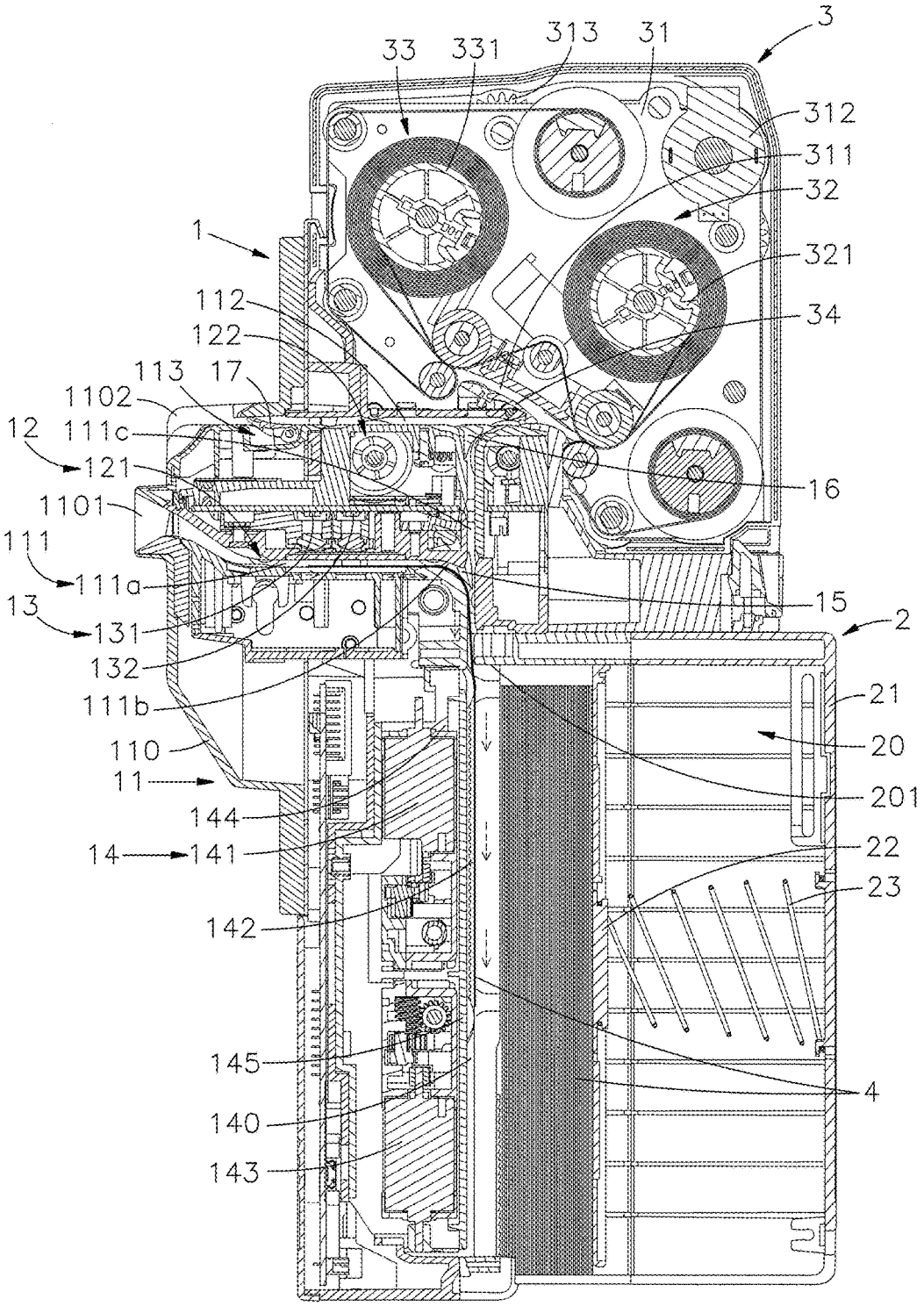
FIG. 4 is a schematic sectional side view of the dual-bill passage auto-search bill acceptor in accordance with the present invention, illustrating the path of the delivery of bills into the cash box.
Figure 5:
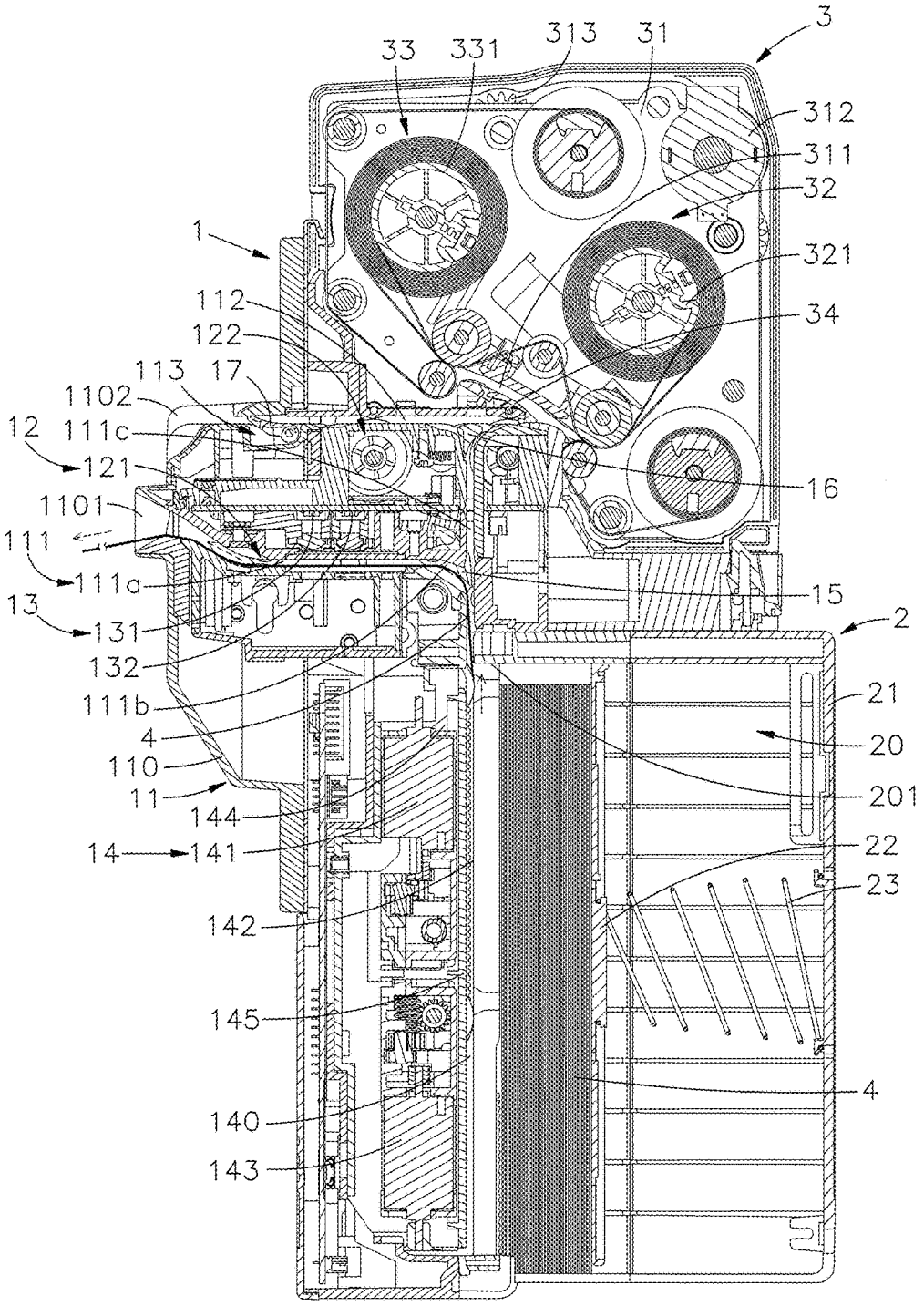
FIG. 5 is a schematic sectional side view of the dual-bill passage auto-search bill acceptor in accordance with the present invention, illustrating a bill returned through the bill-inlet passage to the bill-inlet slot.

Referring to FIGS. 4 and 5, when a user inserts a bill 4 into the bill-inlet slot 1101 of the acceptor housing 1 toward the bill-inlet passage 111, a sensor of the control system will detect the presence of the inserted bill 4 in the bill-inlet passage 111 and activate the motor of the bill-transfer mechanism 12 to rotate the first bill-transfer roller set 121, thereby transferring the bill 4 to the bill recognition device 13 where the light transmitter 131 and the light receiver 132 of the bill recognition device 13 are activated to detect the authenticity of the bill 4 subject to the control of the control system. If the bill recognition device 13 detected that the bill 4 is a true bill, the first bill-transfer roller set 121 will be driven to transfer the bill 4 from the front section 111*a* of the bill-inlet passage 111 to the curved section 111*b* to bias the anti-theft hook 15 and to continuously transfer the bill 4 downwardly through the curved section 111*b* into the bill-pressing passage 140 of the bill-presser 14, and the first motor 141 will then be controlled to rotate the transmission wheel set 142, thereby carrying the bill 4 to a predetermined position where the bill 4 faces toward the opening 201 of the cash box 2. At this time, the first motor 141 will be stopped, awaiting the user to proceed to a follow-up procedure for exchange, purchase of goods, consumer services.

When the control system confirms the execution of the trading order, the control system will judge whether or not the bill 4 can be used for giving change. If the bill 4 is of the maximum denomination and cannot be used for giving change, the transmission wheel set 142 of the bill-presser 14 will be driven to carry the bill 4 continuously forward. After the bill 4 is completely moved over the anti-theft hook 15, the anti-theft hook 15 will automatically return to its previous position, and the second motor 143 of the bill-presser 14 will be controlled to move the bill-pressing plate 145 through the linkage 144, causing the bill-pressing plate 145 to push the bill 4 through the opening 201 of the cash box 2 onto the bearing plate 22 and to further force the bearing plate 22 against the spring members 23 and enabling the bill 4 to be received in the bill accommodation chamber 20 of the cash box 2. Thereafter, the bill-pressing plate 145 is returned to its previous position, and the bearing plate 22 is pushed back toward the opening 201 by the elastic restoring energy of the spring members 23, enabling the received bill 4 to be secured in place between the bearing plate 22 and an inner edge of the box body 21 around the opening 201. In application, the aforesaid procedure is repeated again and again, and thus, a plurality of bills 4 are properly received and stored in the cash box 2 in a stack. Further, if the user cancel the trading or the bill recognition device 13 recognizes the inserted bill 4 to be a counterfeit, the first bill-transfer roller set 121 of the bill-transfer mechanism 12 will be operated to mate with the operation of the transmission wheel set 142 of the bill-presser 14 for a bill return process, carrying the inserted counterfeit bill 4 reversely along the bill-inlet passage 111 to the bill-inlet slot 1101 to return the counterfeit bill 4 to the user.

Figure 6:
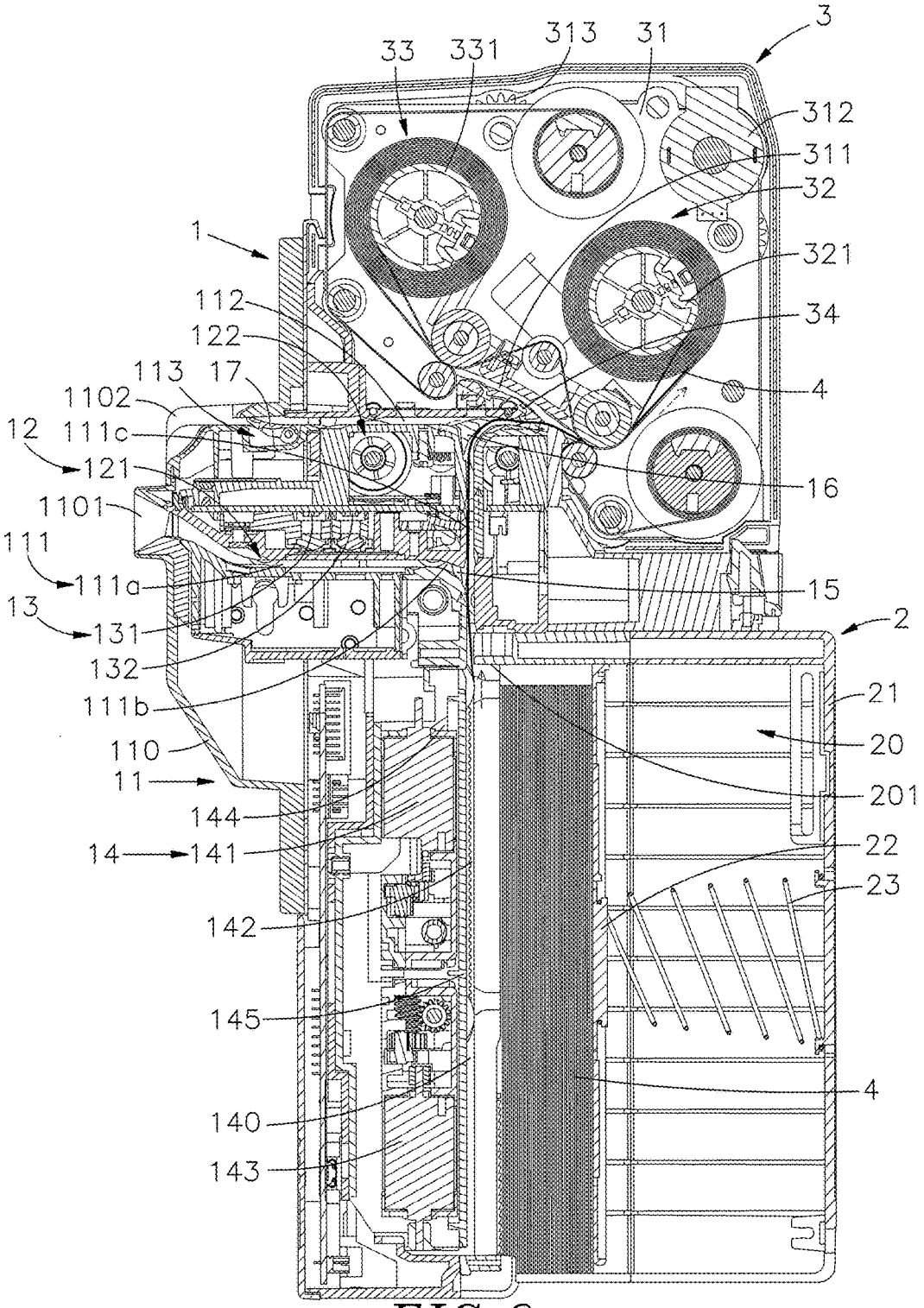
FIG. 6 is a schematic sectional side view of the dual-bill passage auto-search bill acceptor in accordance with the present invention, illustrating a bill collection operation of the bill dispenser.
Figure 7:
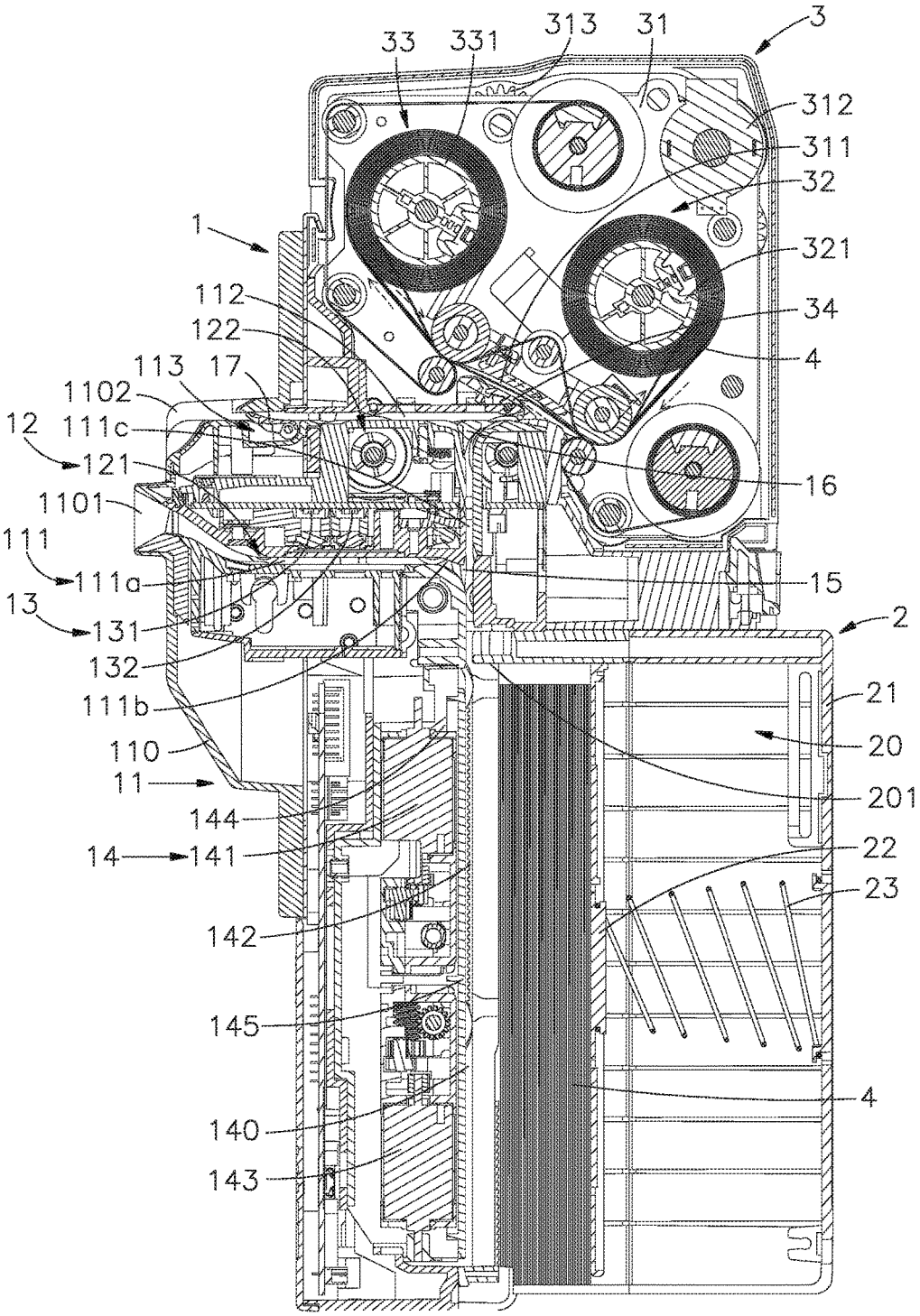
FIG. 7 is a schematic sectional side view of the dual-bill passage auto-search bill acceptor in accordance with the present invention, illustrating a giving-change operation of the bill dispenser (I).
Figure 8:
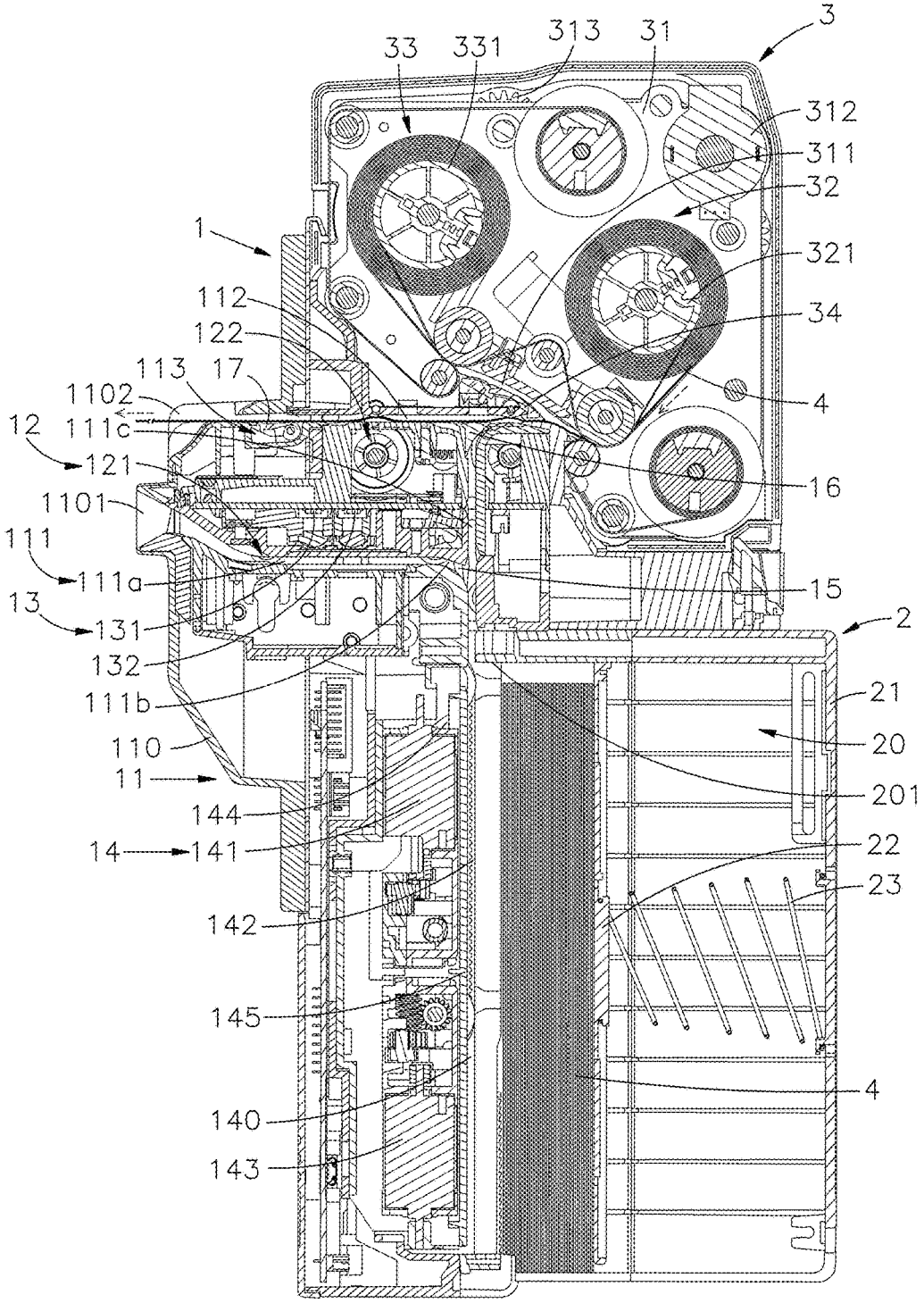
FIG. 8 is a schematic sectional side view of the dual-bill passage auto-search bill acceptor in accordance with the present invention, illustrating a giving-change operation of the bill dispenser (II).

Referring to FIG. 6, FIG. 7 and FIG. 8, the bill intake and bill return processes of the acceptor housing 1 are same as conventional bill acceptors with the exception of the action after confirmed the trading. When the control system confirms the execution of the trading order, the control system will judge whether or not the bill 4 can be used for giving change. If the bill 4 can be used for giving change, the transmission wheel set 142 of the bill-presser 14 will be driven to carry the bill 4 from the position adjacent to the cash box 2 along the bill-pressing passage 140 upwardly over the anti-theft hook 15 to the shunt section 111*c* of the bill-inlet passage 111 to push the anti-backflow gate 16 to bias, allowing the bill 4 to be moved into the bill-return passage 311 of the dispenser housing 31 of the bill dispenser 3 for a bill collection process. After the bill 4 completely passed over the bill-return passage 311, the anti-backflow gate 16 automatically returns to its previous position to stop the bill 4 from being moved back, avoiding blockage or jamming. Further, the arrangement of the anti-theft hook 15 prevents the inserted bill 4 from being pulled back by a tool by an evil user.

When the control system of the acceptor housing 1 controls the bill dispenser 3 to run the bill collection process, the motor 312 of the dispenser housing 31 drives the gear transmission mechanism 313 to rotate the first bill-receiving wheel 321 of the storage module 32, circulating transmission means of drive and drive rollers and an endless belt thereof and carrying the bill 4 through the bill-return passage 311 into the storage module 32, and the bill 4 can then be rolled up and secured to the periphery of the first bill-receiving wheel 321; the motor 312 can also drive the gear transmission mechanism 313 to rotate the second bill-receiving wheel 331 of the register module 33, circulating transmission means of drive and drive rollers and an endless belt thereof and carrying the bill 4 through the control gate 34 into the register module 33, enabling the bill 4 to be rolled up and secured to the periphery of the second bill-receiving wheel 331.

As stated above, after the control system confirms the trading, the inserted bill 4 has reached a specific area in the bill dispenser 3. If the trading is needed to give change, the control system will pick up the specific bill 4 from the mixed bills 4 in the storage module 32. The procedure of giving change is as follows: Assuming that the first bill-receiving wheel 321 of the storage module 32 has 7 pieces of bills 4 wound thereon, if the result of the trade calculation made by the control system is to give the client the third bill 4, the fourth bill 4 the seventh bill 4 on the first bill-receiving wheel 321 for change, the control system will control the first bill-receiving wheel 321 to rotate reversely, returning the first bill 4, the second bill 4, the fifth bill 4 and the sixth bill 4 back to the bill-return passage 311 of the dispenser housing 31, and will control the electromagnetic valve of the control gate 34 to bias the control gate 34 toward the bill-outlet passage 112, switching the bill-transfer passage from the storage module 32 to the register module 33, so that the selected bills 4 can be delivered to the register module 33 and wound around the second bill-receiving wheel 331 for temporary storage. The aforesaid third, fourth and seventh bills 4 can then be transferred over the control gate 34 into the bill-outlet passage 112 as the control gate 34 closes the bill-transfer passage between the storage module 32 and the register module 33. Thereafter, the first bill-transfer roller set 121 of the bill-transfer mechanism 12 will be rotated to transfer these bills 4 toward the outside of the bill-outlet slot 1102. After give the change to the client, the second bill-receiving wheel 331 will then be rotated to release the first, second, fifth and sixth bills 4, enabling these bills 4 to be moved over the control gate 34 along the bill-return passage 311 to the storage module 32 and then rolled up onto the first bill-receiving wheel 321 for further dispensing or accumulation in the follow-up trade calculation.

Further, if the control system judges that the trading is needed to give change and if the first few bills 4 of the mixed bills 4 in the storage module 32 are in the sequence for giving change, the first bill-receiving wheel 321 will be reversed to release these bills 4, and the control gate 34 will be biased to close the bill-transfer passage between the storage module 32 and the register module 33, prohibiting these bills 4 from being transferred to the register module 33 for temporary storage, and enabling these bills 4 to be directly transferred over the control gate 34 along the bill-outlet passage 112 toward the outside of the bill-outlet slot 1102 to complete the procedure of giving change.

In this embodiment, after confirmed the trading, if the control system of the acceptor housing 1 judges according to the detection of the bill recognition device 13 that the inserted bill 4 is a true bill of the maximum denomination, the bill-transfer mechanism 12 will be driven to transfer the inserted bill 4 along the bill-inlet passage 111 in the base 11 to the bill-presser 14 for pressing by the bill-presser 14 into the cash box 2. In case the bill 4 can be used for giving change, the will 4 will be transferred through the bill-return passage 31 in the dispenser housing 31 of the bill dispenser 3 and then rolled up onto the first bill-receiving wheel 321 of the storage module 32. If the result of the trading calculation needs to give change, the bills 4 to be given to the user for change will then be transferred through the bill-return passage 31 into the bill-outlet passage 112 above the bill-inlet passage 111 for giving to the user; the other bills 4 that need not to be used for giving change will be transferred through the bill-transfer passage between the storage module 32 and the register module 33 subject to the control of the control gate 34, and then rolled up onto the second bill-receiving wheel 331 of the register module 33. After giving change to the user, the other bills 4 that can be used for giving change are sent back to the storage module 32 subject to the control of the control gate 34, and then rolled up onto the first bill-receiving wheel 321 for further use.

As stated above, the bill dispenser 3 of the invention can control an electromagnetic valve or other electric driving device (not shown) to move the control gate 34 between an open position and a close position, switching the bill-transfer passage between the storage module 32 and the register module 33, so that the bill dispenser 3 can pick up the specific bills 4 from the mixed bills 4 and directly transfer the non-specific bills 4 to the register module 33 for temporary storage, and then transfer these non-specific bills 4 back to the storage module 32 for storage after finished the procedure of giving change, and these non-specific bills 4 can be used for giving change in a further operation. Since this one single bill dispenser 3 is capable of achieving the above-described operation, it does not occupy much installation space in the acceptor housing 1, simplifying the overall structure of the bill acceptor, minimizing the amount of component parts, facilitating installation and reducing the manufacturing cost. Further, the dual-bill passage design of the bill-inlet passage 111 and the bill-outlet passage 112 of the acceptor housing 1 eliminates the problem of jammed bill in a complicated multi-gate structural design of one single bill passage, providing clients with convenience and practicality in trading.

However, many methods can be applied to the control system of the acceptor housing 1 and the bill dispenser 3 for controlling the storage module 32 and the register module 33 to dispense and store the bills 4 for giving change, for example, controlling the motor 312 to drive the gear transmission mechanism 313 in rotating the first bill-receiving wheel 321 and the second bill-receiving wheel 331 so as to cycle an endless belt and to adjust its tension, enabling the bills 4 to be rolled up onto the first bill-receiving wheel 321 or the second bill-receiving wheel 331 accurately for storage, and the control gate 34 can be controlled to open or close the bill passage between the storage module 32 and the register module 33 for allowing transfer of bills 4 between the storage module 32 and the register module 33 subject to the detection of sensor means in detecting the position of the control gate 34. In actual application, any other measures or structural designs can be selectively used as a substitute to achieve the control of the position of the control gate 34 and the control of the operation of the first bill-receiving wheel 321 of the storage module 32 and the control of the operation of the second bill-receiving wheel 331 of the register module 33.

Figure 9:
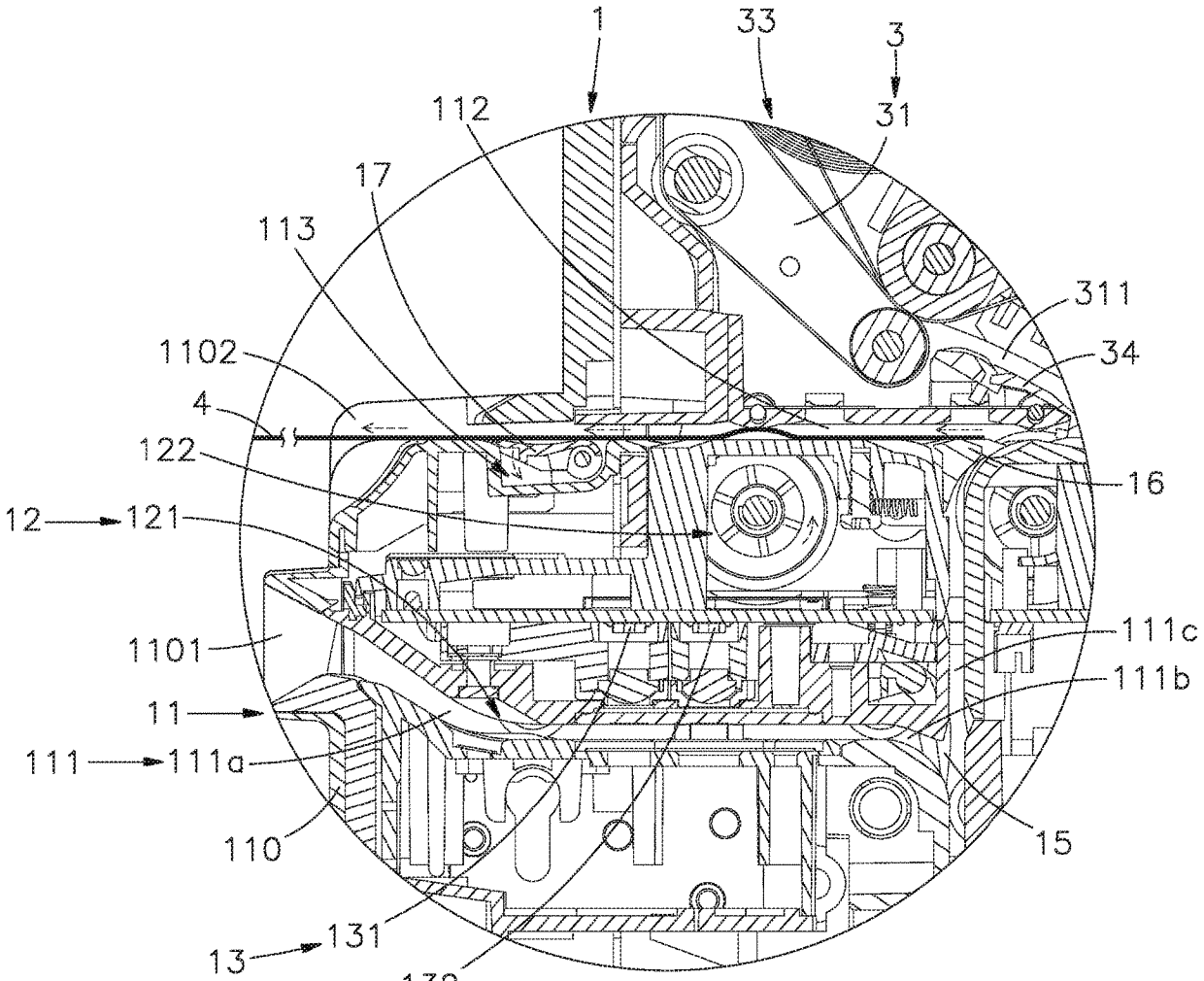
FIG. 9 is a schematic sectional side view of a part of the dual-bill passage auto-search bill acceptor in accordance with the present invention, illustrating the bill dispenser transferred a bill into the bill-outlet passage for giving change to the user.
Figure 10:
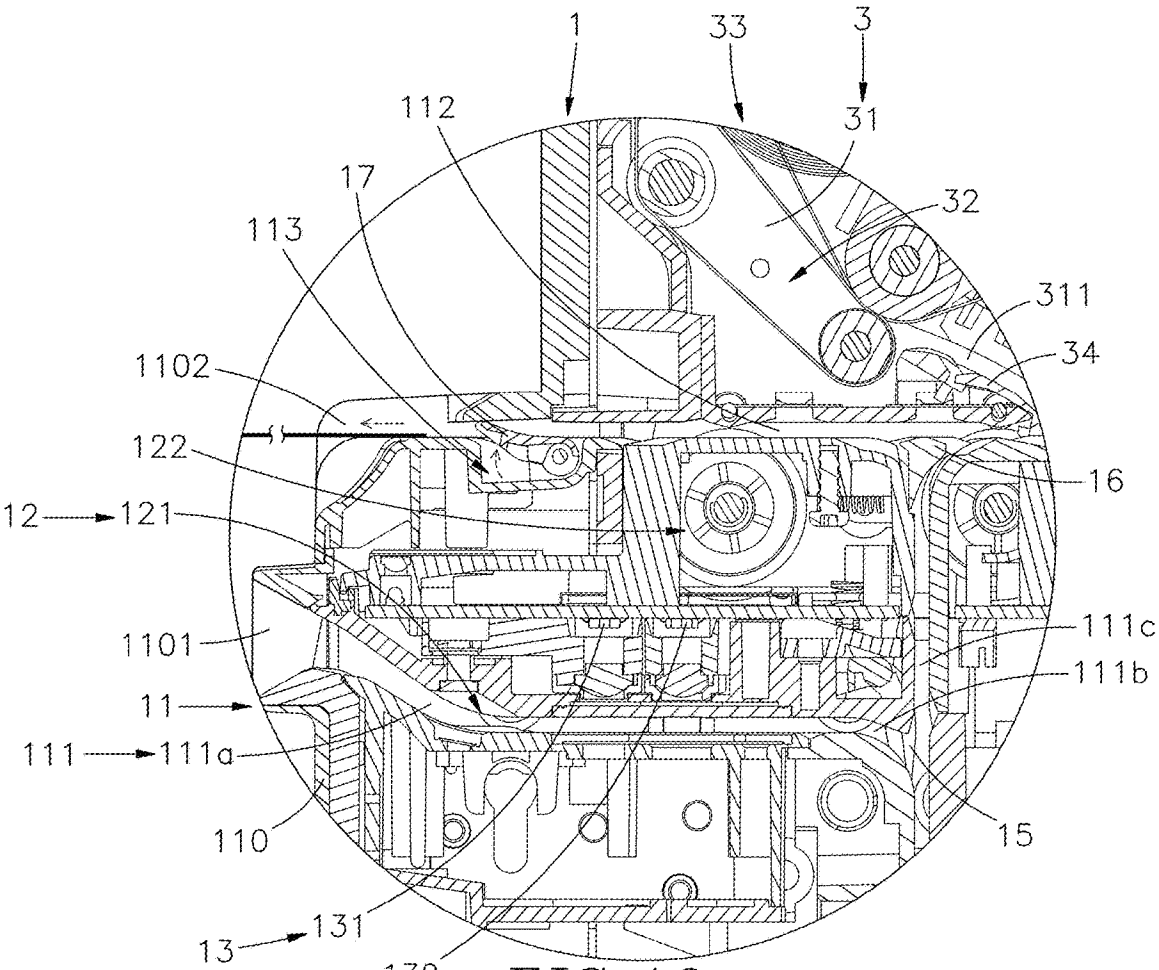
FIG. 10 corresponds to FIG. 9, illustrating the bill transferred out of the bill-outlet passage and the bill-outlet slot of the acceptor housing.

Referring to FIGS. 9 and 10, the acceptor housing 1 further comprises a recessed portion 113 located in the base 11 and facing toward the bill-outlet slot 1102 of the face panel 110 and the bill-outlet passage 112, and a fence-like auto-return safety gate 17 pivotally mounted in the recessed portion 113. When the bill dispenser 3 transfers the bill 4 into the bill-outlet passage 112 for giving change to the user, the fence-like auto-return safety gate 17 will be biased toward the recessed portion 113 by the bill 4 so that the bill 4 can pass over the fence-like auto-return safety gate 17. After the bill 4 passed over the fence-like safety gate 17, the fence-like auto-return safety gate 17 is automatically returned to its previous position. If a user inserts the bill 4 or any other object through the bill-outlet slot 1102 of the face panel 110 toward the bill-outlet passage 112 in the base 11, the inserted bill or object will be stopped outside the bill-outlet passage 112 by the fence-like auto-return safety gate 17, preventing the inserted bill 4 or object from blocking the bill-outlet passage 112.

Further, the anti-theft hook 15, the anti-backflow gate 16 and the fence-like auto-return safety gate 17 are respectively loaded with a spring such that the anti-theft hook 15, the anti-backflow gate 16 and the fence-like auto-return safety gate 17 are respectively biasable by moving the bill 4 for enabling the bill 4 to pass, and will be automatically returned to their respective previous position after the bill 4 passed. In an alternate form of the present invention, an electromagnetic valve or any other suitable electric control device can be used for moving the fence-like auto-return safety gate 17 through a linkage to close or open the bill-outlet passage 112 subject to the detection of a sensor.

In conclusion, the invention provides a dual-passage auto-search bill acceptor, which comprises an acceptor housing 1, a cash box 2 mounted at the back side of the acceptor housing 1 that comprises a base 11, a bill-inlet passage 111 and a bill-outlet passage 112 defined in the base 11 at different elevations, a bill-presser 14 mounted in the base 11 at a bottom side and a bill-transfer mechanism 12 mounted in the base 11 and adapted for transferring each inserted bill 4 of the maximum denomination from the bill-inlet passage 111 to the bill-presser 14, the cash box 2 mounted in a rear bottom side of the acceptor housing 1 for receiving each bill 4 of the maximum denomination from the bill-presser 14, and a bill dispenser 3 mounted at the top side of the acceptor housing 1. The bill dispenser 3 comprises a storage module 32 with a first bill-receiving wheel 321, a register module 33 with a second bill-receiving wheel 331 and a control gate 34 for switching the bill passage between the storage module 32 and the register module 33, and is adapted for performing a bill-collection process and a giving-change process. When performing the bill-collection process, to take up the bills 4 from the bill-presser 14 that can be used for giving change, and giving-change process selectively. When performing the bill collection process, the second bill-receiving wheel 331 of the storage module 32 is rotated to take up the bills 4 that can be used for giving change and that are transferred from the bill-presser 14. When performing the giving-change process, the bill dispenser 3 picks up the specific bills 4 from the mixed bills 4 on the first bill-receiving wheel 321, and transfers these specific bills 4 into the bill-outlet passage 112 for giving change to the user, enabling the bills 4 coming before the specific bills 4 to be transferred over the control gate 34 into the register module 33 and rolled up onto the second bill-receiving wheel 331 for temporary storage and then delivered back to the storage module 32 for storage after completion of the procedure of giving change.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A bill acceptor comprising:

an acceptor housing comprising a base, a bill-inlet passage defined in said base for receiving a bill inserted by a user, a bill-outlet passage defined in said base and extended upwardly from a rear end of said bill-inlet passage, a bill-transfer mechanism mounted in said base for transferring said bill through said bill-inlet passage for said bill intake or a bill return and also for transferring said bill through said bill-outlet passage for giving change, and a bill-presser mounted in said base below said bill-transfer mechanism;

a cash box comprising a box body mounted at a rear bottom side of said base of said acceptor housing and defining therein a bill accommodation chamber for receiving said bills being pressed by said bill-presser; and a bill dispenser comprising a dispenser housing mounted at a top side of said base of said acceptor housing, a bill-return passage defined in said dispenser housing in communication with said bill-inlet passage and said bill-outlet passage, a storage module mounted in said dispenser housing, said storage module comprising a first bill-receiving wheel facing toward said bill-return passage, a register module mounted in said dispenser housing, said register module comprising a second bill-receiving wheel facing toward said bill-return passage, and a control gate mounted in said dispenser housing and biasable to open and close a bill passage between said storage module and said register module;

wherein said bill dispenser is adapted for performing a bill-collection process and a giving-change process selectively; when performing said bill collection process, said bill-transfer mechanism is controlled to transfer said bill from said bill-return passage to said storage module for enabling the said bill to be rolled up onto said first bill-receiving wheel; when performing said giving-change process, said first bill-receiving wheel is controlled to transfer specific bills from mixed bills through said bill-return passage into said bill-outlet passage for giving change to the user, enabling said bills coming before said specific bills to be transferred over said control gate into said register module and rolled up onto said second bill-receiving wheel for temporary storage and then delivered back to said storage module for storage after completion of the procedure of giving change.

2. The bill acceptor as claimed in claim 1, wherein said bill-transfer mechanism of said acceptor housing comprises a first bill-transfer roller set mounted in said base to face toward said bill-inlet passage and controllable to transfer said bill from said bill-inlet passage to said bill-presser or said bill-inlet passage, and a second bill-transfer roller set mounted in said base to face toward said bill-outlet passage for transferring said bill from said bill dispenser into said bill-outlet passage toward the outside of said bill acceptor.

3. The bill acceptor as claimed in claim 1, wherein said acceptor housing further comprises a recessed portion located in said base and facing toward said bill-outlet passage, and a fence-like auto-return safety gate pivotally mounted in said recessed portion for prohibiting movement of said bill from said bill-outlet slot into said bill-outlet passage and allowing movement of said bill from said bill-outlet passage toward said bill-outlet slot.

4. The bill acceptor as claimed in claim 1, wherein said acceptor housing further comprises a bill-pressing passage longitudinally defined in said base at a back side of said bill-presser and connected to an inner end of said bill-inlet passage; said bill-presser comprises a first motor, a transmission wheel set rotatably by said first motor, a second motor, a linkage coupled between said second motor and said bill-pressing plate and drivable by said second motor to move a bill-pressing plate; said box body defines an opening facing toward said bill-presser; said cash box further comprises a bearing plate placed in said bill accommodation chamber and pressable by said bill-pressing plate to move in said bill accommodation chamber, and a plurality of spring members mounted in a bottom side of said bill accommodation chamber and abutted against a bottom wall of said bearing plate to support said bearing plate in said bill accommodation chamber in balance and adapted for imparting an elastic restoring force to said bearing plate toward the said opening of said box body.

5. The bill acceptor as claimed in claim 1, wherein said bill dispenser further comprises at least one motor mounted in said dispenser housing, and a gear transmission mechanism mounted in said dispenser housing and drivable by said motor to rotate said first bill-receiving wheel of said storage module and said second bill-receiving wheel of said register module.

6. The bill acceptor as claimed in claim 1, wherein said acceptor housing further comprises a face panel mounted on a front side of said base, said face panel comprising a bill-inlet slot and a bill-outlet slot respectively disposed in communication with said bill-inlet passage and said bill-outlet passage; said bill-inlet passage comprises a front section disposed in communication with said bill-inlet slot, a curved section curved downwardly from an inner end of said front section remote from said bill-inlet slot and terminating in a said bill-pressing passage, and a shunt section upwardly extended from said curved section and terminating in said bill-outlet passage.

7. The bill acceptor as claimed in claim 6, wherein said acceptor housing further comprises a recessed portion located in said base and facing toward said bill-outlet slot, and a fence-like auto-return safety gate pivotally mounted in said recessed portion for prohibiting movement of said bill from said bill-outlet slot into said bill-outlet passage and allowing movement of said bill from said bill-outlet passage toward said bill-outlet slot.

8. The bill acceptor as claimed in claim 6, wherein said acceptor housing further comprises an anti-theft hook pivotally mounted in said curved section of the bill-inlet passage.

9. The bill acceptor as claimed in claim 8, wherein said acceptor housing further comprises an anti-backflow gate pivotally mounted in the connection area between said shunt section and said bill-outlet passage.

10. The bill acceptor as claimed in claim 1, wherein said acceptor housing further comprises a bill recognition device mounted in said base to face toward said bill-inlet passage and adapted for recognizing the authenticity of each bill being transferred by said bill-transfer mechanism so that if said bill is recognized by said bill recognition device to be a true bill of a maximum denomination, said bill-transfer mechanism is controlled to transfer said bill to said bill-presser, and then said bill-presser is controlled to press said bill into said box body of said cash box; if said bill is recognized by said bill recognition device to be a counterfeit or the user cancels the trading, said bill-transfer mechanism is controlled to transfer the bill backwardly through said bill-inlet passage for returning said bill to the user.

11. The bill acceptor as claimed in claim 10, wherein when said bill recognition device judges said bill is usable for giving change, said bill presser is controlled to transfer said bill upwardly through said bill-inlet passage toward a bill-return passage of said bill dispenser.

12. The bill acceptor as claimed in claim 10, wherein said bill recognition device of said acceptor housing comprises a light transmitter and a light receiver respectively mounted at the same side or two opposite sides of said bill-inlet passage.

* * * * *